US006429823B1

(12) United States Patent
Bains et al.

(10) Patent No.: US 6,429,823 B1
(45) Date of Patent: Aug. 6, 2002

(54) HORN REFLECT ARRAY

(75) Inventors: Paramjit S. Bains, Los Angeles; Parthasarathy Ramanujam, Redondo Beach, both of CA (US)

(73) Assignee: Hughes Electronics Corporation, El Segundo, CA (US)

( * ) Notice: Subject to any disclaimer, the term of this patent is extended or adjusted under 35 U.S.C. 154(b) by 0 days.

(21) Appl. No.: 09/637,341

(22) Filed: Aug. 11, 2000

(51) Int. Cl.[7] ..... H01Q 19/10
(52) U.S. Cl. ..... 343/755; 343/777; 343/914
(58) Field of Search ..... 343/754, 755, 343/912, 786, 700 MS, 853, 914, 781 R, 776, 777; H01Q 19/00, 19/10, 1/38

(56) References Cited

U.S. PATENT DOCUMENTS

RE28,546 E * 9/1975 Foldes ..... 343/858
4,198,640 A * 4/1980 Bowman ..... 343/754
4,684,952 A * 8/1987 Munson et al. ..... 343/700 MS
5,543,809 A * 8/1996 Profera ..... 343/753
6,081,234 A * 6/2000 Huang et al. ..... 343/700 MS
6,195,047 B1 * 2/2001 Richards ..... 343/700 MS

* cited by examiner

*Primary Examiner*—Michael C. Wimer
(74) *Attorney, Agent, or Firm*—Gates & Cooper LLP

(57) ABSTRACT

In summary the present invention discloses a horn reflect array antenna system and a method for producing a signal using a horn reflect array antenna. The system comprises at least one reflective element illuminated by an incident radio frequency (RF) signal from a feed horn, the reflective element reflecting a portion of the incident RF signal as a portion of a reflected RF signal, and at least one phase shifting device, each phase shifting device coupled to a corresponding reflective element, wherein a beam pattern of the reflected RF signal is altered when the phase shifting element changes the phase of the portion of the reflected RF signal. A method in accordance with the present invention comprises illuminating a reflector with an RF signal emanating from a feed horn, wherein the reflector comprises at least one reflective element, reflecting at least a portion of the RF signal from the reflective element, wherein the reflective element comprises a phase shifting device, and changing a phase of the portion of the reflected RF signal with the phase shifting device, therein altering the radiation pattern of the reflected RF signal.

17 Claims, 5 Drawing Sheets

HORN REFLECT ARRAY

BACKGROUND OF THE INVENTION

1. Field of the Invention

This invention relates in general to antenna systems, and in particular to a horn reflect array element for enhanced performance.

2. Description of Related Art

Communications satellites have become commonplace for use in many types of communications services, e.g., data transfer, voice communications, television spot beam coverage, and other data transfer applications. As such, satellites must provide signals to various geographic locations on the Earth's surface. As such, typical satellites use customized antenna designs to provide signal coverage for a particular country or geographic area.

Typical antenna systems use either parabolic reflectors or shaped reflectors to provide a specific beam coverage, or use a flat reflector system with an array of reflective printed patches or dipoles on the flat surface. These "reflect array" reflectors used in antennas are designed such that the reflective patches or dipoles shape the beam much like a shaped reflector or parabolic reflector would, but are much easier to manufacture and package on the spacecraft.

However, satellites typically are designed to provide a fixed satellite beam coverage for a given signal. For example, Continental United States (CONUS) beams are designed to provide communications services to the entire continental United States. Once the satellite transmission system is designed and launched, changing the beam patterns is difficult.

The need to change the beam pattern provided by the satellite has become more desirable with the advent of direct broadcast satellites that provide communications services to specific areas. As areas increase in population, or additional subscribers in a given area subscribe to the satellite communications services, e.g., DirecTV, satellite television stations, local channel programming, etc., the satellite must divert resources to deliver the services to the new subscribers. Without the ability to change beam patterns and coverage areas, additional satellites must be launched to provide the services to possible future subscribers, which increases the cost of delivering the services to existing customers.

Some present systems are designed with minimal flexibility in the delivery of communications services. For example, a semi-active multibeam antenna concept has been described for mobile satellite antennas. The beams are reconfigured using a Butler matrix and a semi-active beamformer network (BFN) where a limited number (3 or 7) of feed elements are used for each beam and the beam is reconfigured by adjusting the phases through an active BFN. This scheme provides limited reconfigurability over a narrow bandwidth and employs complicated and expensive hardware.

Another minimally flexible system uses a symmetrical Cassegrain antenna that uses a movable feed horn, which defocuses the feed and zooms circular beams over a limited beam aspect ratio of 1:2.5. This scheme has high sidelobe gain and low beam-efficiency due to blockage by the feed horn and the subreflector of the Cassegrain system. Further, this type of system splits or bifurcates the main beam for beam aspect ratios greater than 2.5, resulting in low beam efficiency values.

It can be seen, then, that there is a need in the art for a communications system that can be reconfigured in-flight to accommodate the changing needs of uplink and downlink traffic. It can also be seen that there is a need in the art for a communications system that can be reconfigured in-flight without the need for complex systems. It can also be seen that there is a need in the art for a communications system that can be reconfigured in-flight that has high beam-efficiencies and high beam aspect ratios.

SUMMARY OF THE INVENTION

To overcome the limitations in the prior art described above, and to overcome other limitations that will become apparent upon reading and understanding the present specification, the present invention discloses a horn reflect array antenna system and a method for producing a signal using a horn reflect array antenna. The system comprises at least one reflective element illuminated by an incident radio frequency (RF) signal from a feed horn, the reflective element reflecting a portion of the incident RF signal as a portion of a reflected RF signal, and at least one phase shifting device, each phase shifting device coupled to a corresponding reflective element, wherein a beam pattern of the reflected RF signal is altered when the phase shifting element changes the phase of the portion of the reflected RF signal.

A method in accordance with the present invention comprises illuminating a reflector with an RF signal emanating from a feed horn, wherein the reflector comprises at least one reflective element, reflecting at least a portion of the RF signal from the reflective element, wherein the reflective element comprises a phase shifting device, and changing a phase of the portion of the reflected RF signal with the phase shifting device, therein altering the radiation pattern of the reflected RF signal.

The present invention provides a communications system that can be reconfigured in-flight to accommodate the changing needs of uplink and downlink traffic. The present invention also provides a communications system that can be reconfigured in-flight without the need for complex systems. The present invention also provides a communications system that can be reconfigured in-flight that has high beam-efficiencies and high beam aspect ratios.

BRIEF DESCRIPTION OF THE DRAWINGS

Referring now to the drawings in which like reference numbers represent corresponding parts throughout.

DETAILED DESCRIPTION OF THE PREFERRED EMBODIMENT

In the following description of the preferred embodiment, reference is made to the accompanying drawings which form a part hereof, and in which is shown by way of illustration a specific embodiment in which the invention may be practiced. It is to be understood that other embodiments may be utilized and structural changes may be made without departing from the scope of the present invention.

Satellite Environment

Figure 1A:
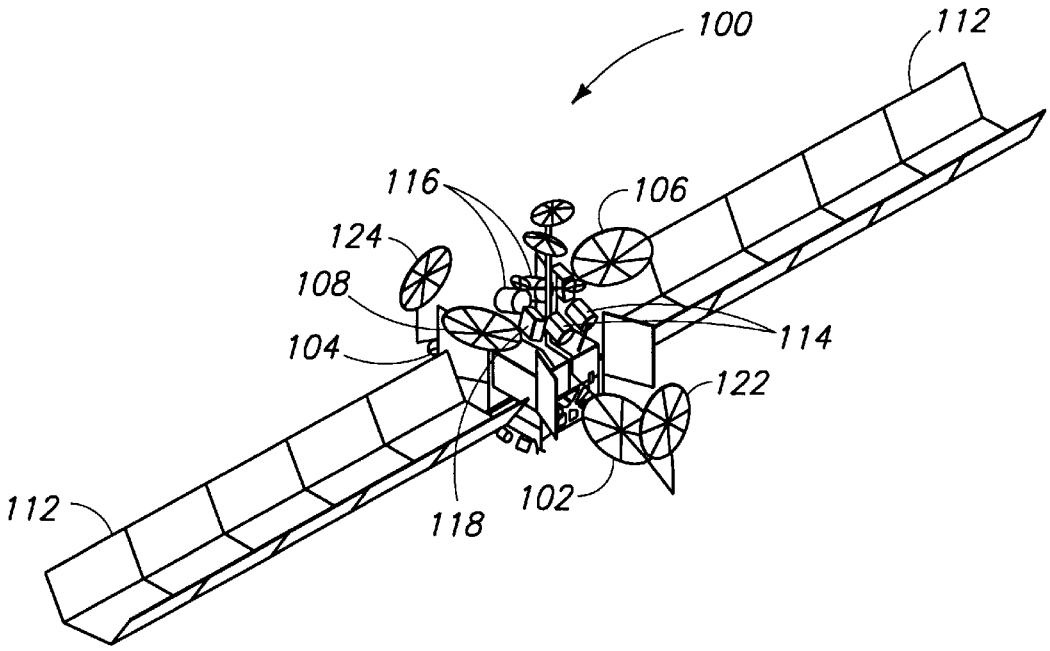
FIGS. 1A and 1B illustrate a typical satellite environment for the present invention.
Figure 1B:
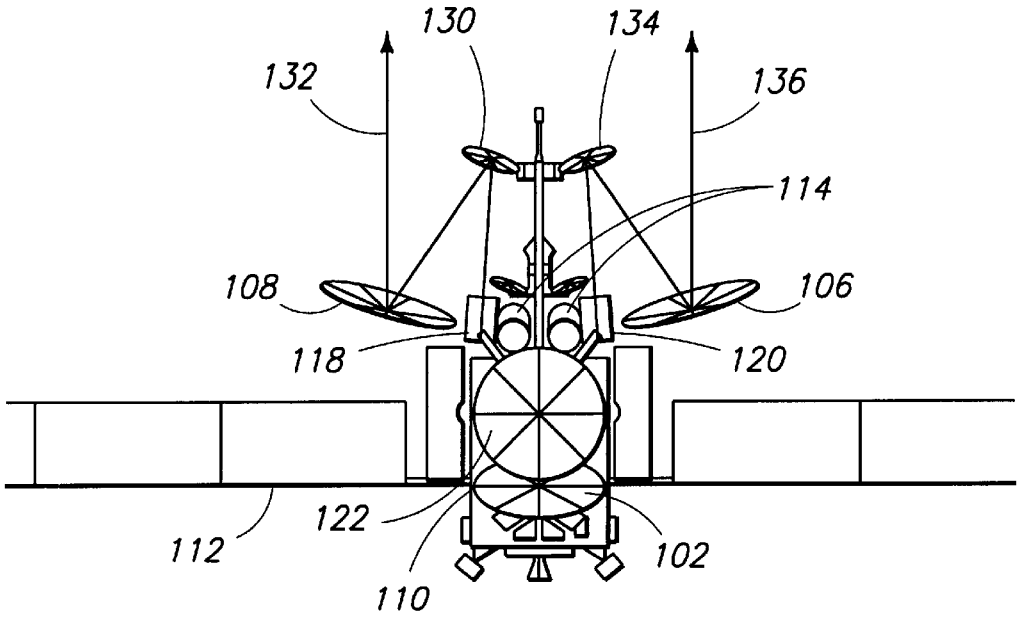

FIGS. 1A and 1B illustrate a typical satellite environment for the present invention.

Spacecraft 100 is illustrated with four antennas 102–108. Although shown as dual reflector antennas 102–108, antennas 102–108 can be direct fed single reflector antennas 102–108 without departing from the scope of the present invention. Antenna 102 is located on the east face of the spacecraft bus 110, antenna 104 is located on the west face of spacecraft bus 110, antenna 106 is located on the north part of the nadir face of the spacecraft bus 110, and antenna 108 is located on the south part of the nadir face of the spacecraft bus 110. Solar panels 112 are also shown for clarity.

Feed horns 114–120 are also shown. Feed horn 114 illuminates antenna 102, feed horn 116 illuminates antenna 104, feed horn 118 illuminates antenna 108, and feed horn 120 illuminates antenna 106. Feed horn 114 is directed towards subreflector 122, which is aligned with antenna 102. Feed horn 116 is directed towards subreflector 124, which is aligned with antenna 104. Feed horns 114–120 can be single or multiple sets of feed horns as desired by the spacecraft designer or as needed to produce the beams desired for geographic coverage. For example, feed horns 114 and 116 are shown as two banks of feed horns, but could be a single bank of feed horns, or multiple banks of feed horns, as desired. Antennas 102 and 104 are shown in a side-fed offset Cassegrain (SFOC) configuration, which are packaged on the East and West sides of the spacecraft bus 110. Antennas 106 and 108 are shown as offset Gregorian geometry antennas, but can be of other geometric design if desired. Further, antennas 102–108 can be of direct fed design, where the subreflectors are eliminated and the feed horns 114–120 directly illuminate reflectors 102–108 if desired. Further, any combination of Cassegrainian, Gregorian, SFOC, or direct illumination designs can be incorporated on spacecraft 100 without departing from the scope of the present invention.

Feed horn 118 illuminates subreflector 130 with RF energy, which is aligned with antenna 108 to produce output beam 132. Feed horn 120 illuminates subreflector 134 with RF energy, which is aligned with antenna 106 to produce beam 136. Beams 132 and 136 are used to produce coverage patterns on the Earth's surface. Beams 132 and 136 can cover the same geographic location, or different geographic locations, as desired. Further, feed horns 118 and 120 can illuminate the antennas 102–108 with more than one polarization of RF energy, i.e., left and right hand circular polarization, or horizontal and vertical polarization, simultaneously.

Although described with respect to satellite installations, the antennas described herein can be used in alternative embodiments, e.g., ground based systems, mobile based systems, etc., without departing from the scope of the present invention. Further, although the spacecraft 100 is described such that the feed horns 114–120 provide a transmitted signal from spacecraft 100 via the reflectors 102–108, the feed horns 114–120 can be diplexed such that signals can be received on the spacecraft 100 via reflectors 102–108.

Overview of the Present Invention

The present invention, instead of using a fixed reflector surface, provides a dynamic reflector surface comprising an array of tunable reflective surfaces. Each element of the array can be tuned separately to change the phase during the process of reflection, and thus the beam pattern generated by the array of tunable reflectors can be changed in-flight in a simple manner.

The array of the present invention is typically assembled in a configuration that resembles a reflector, the array can be parabolic, circular, flat, etc, depending on the desires of the designer for the available or desired beam patterns from the array.

Each reflecting element in the array of the present invention is a horn reflecting device which reflects an electric field emanating from a single feed horn. Each horn in the array has the capability of changing the phase during the process of incidence and reflection. This phase shift can then be used to change the shape of the beam emanating from the array. The phase shift can be incorporated by either using a movable short or by using a variable phase-shifter inside the horn and a short.

The array of the present invention can be on an arbitrary surface to achieve optimum performance. In order to provide multiple beams additional feed horns can be aimed at the array and provide incident Radio Frequency (RF) energy to feed the array. In this situation the phase shift from each element has to be chosen to give optimum performance within all the beams. By using "phase-shifting" which can be controlled on-orbit, a relatively simple reconfigurable antenna can be designed. This approach is much simpler than an active array in terms of cost and complexity.

The horn reflect array of the present invention combines the advantages of both a Direct Radiating Array (DRA) and a shaped reflector. The reconfigurability of the present invention is obtained without using active amplifiers.

Horn Reflect Array Configuration

Figure 2:
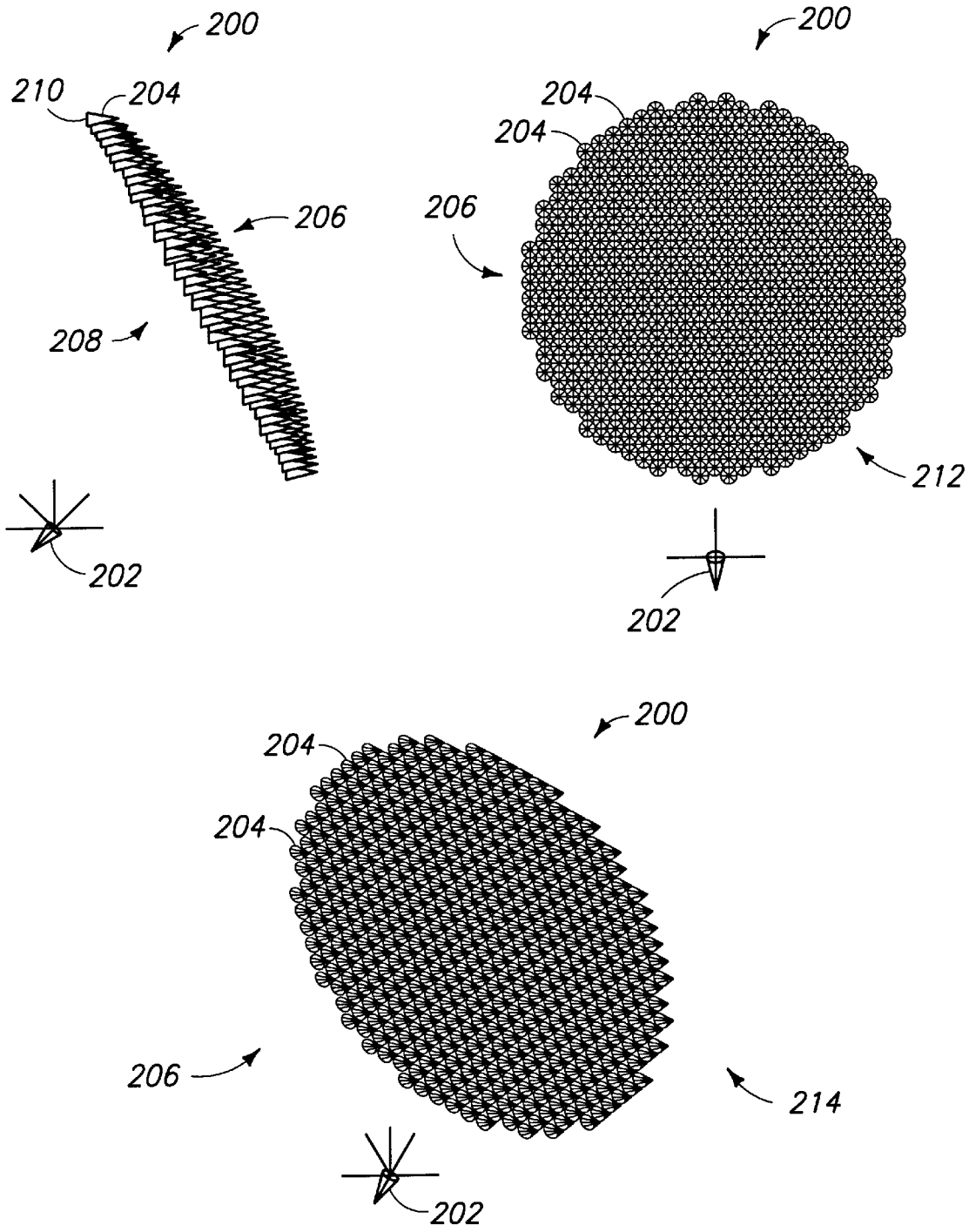
FIG. 2 illustrates a front, side, and isometric view of the horn reflect array of the present invention.

FIG. 2 illustrates a front, side, and isometric view of the horn reflect array of the present invention.

Reflect array 200 is illuminated with RF energy from feed horn 202. Reflect array 200 comprises a plurality of reflective elements 204 that are configured in a reflector array 206. Side view 208 shows that feed horn 202 is pointed at the open end 210 of reflective element 204. Side view 208 also shows that reflector array 206 can be a curved array, although the arrangement of reflective elements 204 comprising reflector array 206 can be of any shape, e.g., parabolic, flat, etc. Further, front view 212 and isometric view 214 show that reflective elements 204 can be placed in a circular arrangement for reflector array 206, but reflective elements 204 can be placed in other reflector array 206 shapes, e.g., elliptical, square, parallelogram, hexagonal, etc. without departing from the scope of the present invention. Each reflective element 204 reflects a portion of the incident RF energy, and by changing the respective phase for each reflective element 204, the respective phase of the portion of the reflected RF energy for each respective reflective element 204 can be changed. By changing the phase of each portion of the reflected RF energy, different beam patterns can be generated by the horn reflect array.

The reflector array 206 of the present invention provides lower non-recurring costs for a satellite. A single reflector array 206 of the present invention can now generate a plurality of different shaped beam patterns without reconfiguring the physical hardware, e.g., without moving the location of the feed horn 202 and the reflective elements 204 in the reflector array 206. As such, design times for satellites that serve different mission scenarios is shorter, since the only thing that must change from mission to mission using the present invention is the programming of the reflective elements 204.

Further, the reflector array 206 of the present invention can be reconfigured on-orbit. Satellites using the reflector array 206 of the present invention, for example, can be designed for use in clear sky conditions, and, when necessary, the beams emanating from the reflector array 206 of the present invention can be shaped to provide higher gains over geographic regions having rain or other poor transmission conditions, thus providing higher margins during clear sky conditions.

In comparison with other reconfigurable antenna arrays, e.g., the active Direct Radiating Array (DRA) and the printed element reflect array, the present invention provides additional mission design flexibility and reconfigurable beam patterns.

The DRA requires an amplifier and a phase shifter behind each element and a beamformer which combines all the elements in the array to properly phase the beam to create the desired beam pattern. While this approach can inherently achieve on-orbit reconfigurability, it is more complex, requires more satellite generated power, creates a heavier satellite, and is more expensive to produce. Further, the amplifier behind each element is typically a Solid State Power Amplifier, and is generally of lower efficiency, which creates even more exaggerated power generation problems.

The printed element reflect array, which is an array of printed elements (dipole or patch elements backed by a ground plane) is fed by a feed horn. By using various sizes of the elements over the array surface, an arbitrary phase distribution and so a shaped beam can be formed. Though the basic radiating mechanism is similar to the present invention the printed element array suffers because the dipole or patch elements have to be varied to vary the beam shape. As such, once the patch or dipole element is attached to the reflector surface, the beam is fixed. Further, the printed dipole elements are inherently frequency sensitive. Even with more complex multi-layer reflect arrays, only a 10% bandwidth can be achieved, whereas the present invention has a higher bandwidth since the horn elements have inherently higher bandwidth (>30%) than the patch or dipole elements.

Since the feed horn 202 is similar to feed horns 202 which are used with current day shaped reflectors, the feed horn 202 can be supplied with RF power from high-efficiency TWT amplifiers. Thus the present invention extends the currently available technology to obtain reconfigurability without any reduction in the power efficiency of the satellite. Additional beams can also be generated by using additional feed horns 202 similar to a conventional reflector antenna.

A simple choice for a reflect array 206 profile is a planar profile. However, this approach has inherently a lower bandwidth due to the non-equal path length phenomenon, e.g., the path length from the feed horn 202 is not equal with respect to each reflective element 204. The bandwidth of the reflect array 200 can be improved by making the profile parabolic, as shown in FIG. 2. If necessary or desired, the profile can be chosen to be any other shape such as hyperbolic, ellipsoidal, spherical, etc.

Horn Reflect Array Reflecting Element

Figure 3:
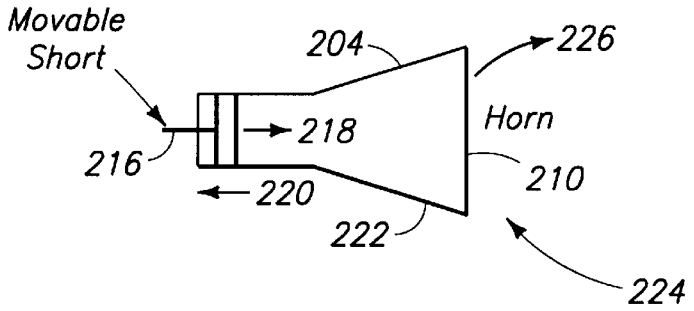
FIG. 3 illustrates the reflecting element as used in the present invention.

FIG. 3 illustrates the reflecting element as used in the present invention.

Reflecting element 204 has a movable short 216 that moves forward in direction 218 and backward in direction 220 with respect to the front opening 210 of horn 222. As short 216 moves in directions 218 and 220, the phase of an incoming (incident) RF signal 224 is changed as it is reflected from short 216 to generate reflected signal (beam) 226. By placing a number of reflecting elements 204 together, and coordinating the movement of shorts 216 in each reflecting element 204, a beam pattern of any desired pattern can be generated, because the phase of each horn 222 will be changed with respect to the other horns, and superposition of the reflected beams 226.

The short 216 can be moved by using a stepper motor or other motion device which moves short 216 in directions 218 and 220 based on the desired phase of reflected beam 226 to generate a desired beam pattern from all of the reflective elements 204. Each reflective element 206 receives the RF incident signal 224 from the feed horn 202, which is reflected by the movable short 216. By changing the position of the short 216 the phase of the radiated signal 226 is varied. By optimizing the position of the short 216 on each of the reflective elements 204 a shaped beam can be formed.

Another approach of achieving a phase shift in the reflective elements 204 is by using an electronic phase shifter backed by a fixed short 216 in each reflective element 204. The phase shift introduced by the phase-shifters can be controlled electronically, which would eliminate the need for motors and the like to move short 216.

Radiation Patterns Generated by the Horn Reflect Array

Figure 4:
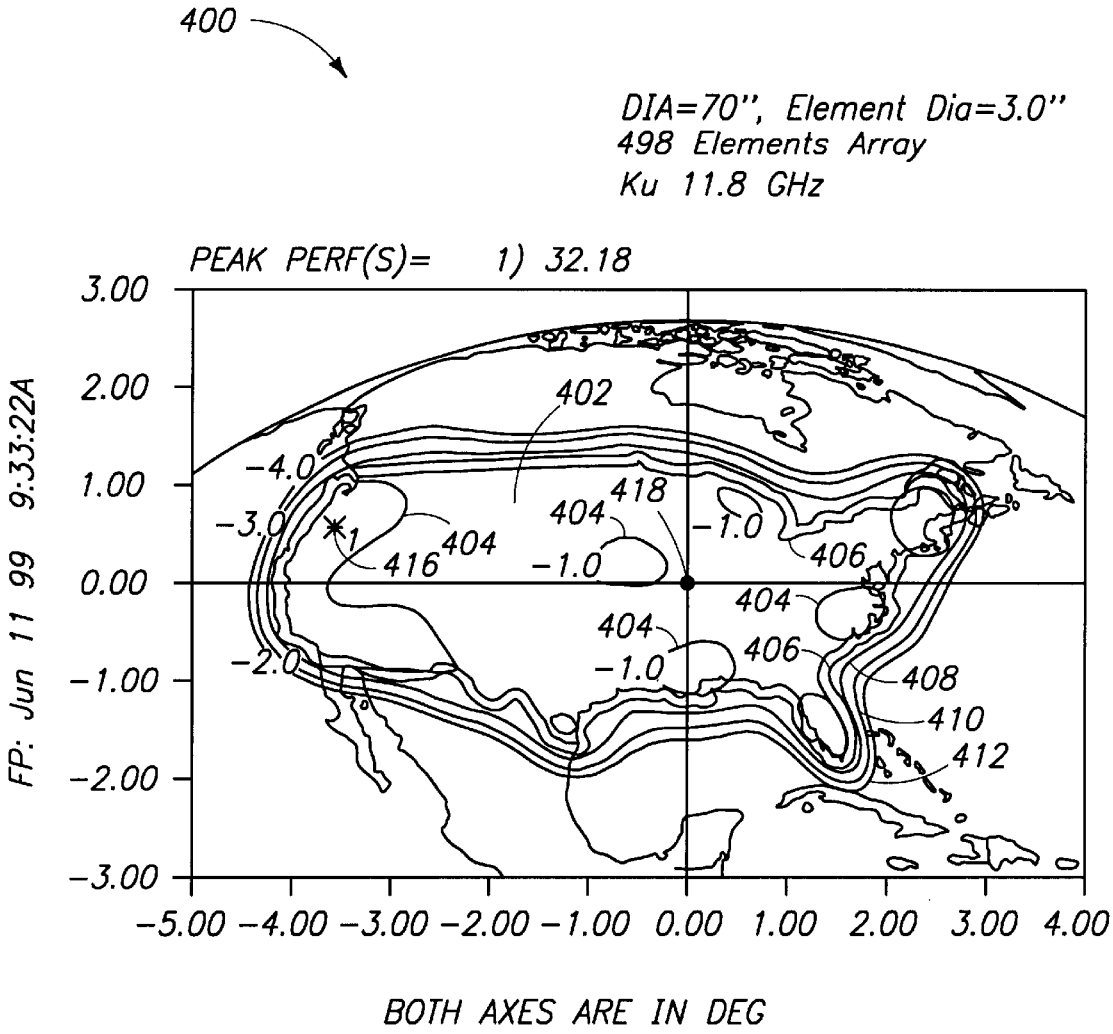
FIG. 4 illustrates a typical radiation pattern obtained using a horn reflect array of the present invention.

FIG. 4 illustrates a typical radiation pattern obtained using a horn reflect array of the present invention.

Graph 400 illustrates the continental United States (CONUS) 402 with equipotential lines 404–412, peak performance point 416, and boresight 418 for the horn reflect array of the present invention. 498 reflective elements 204 were used to create graph 400. Peak performance point 416 is measured at 32.18 dB. Line 404 illustrates where on CONUS 402 a −1 dB difference from the peak performance point 416 would fall geographically. Line 406 illustrates where on CONUS 402 a −2 dB difference from the peak performance point 416 would fall geographically. Line 410 illustrates where on CONUS 402 a −3 dB difference from the peak performance point 416 would fall geographically. Line 412 illustrates where on CONUS 402 a −4 dB difference from the peak performance point 416 would fall geographically.

As can be seen from FIG. 4, the horn reflect array of the present invention provides coverage over the entire CONUS 402 geography with a substantially uniform incident power. Further, the reconfigurable nature of the horn reflect array of the present invention allows for reconfiguration of the equipotential lines 404–414 during poor weather conditions, changes in the traffic pattern within CONUS 402, or inclusion of other geographies such as Mexico or Canada, while the satellite is on-station in orbit. Further, satellites with different shaped beam requirements, e.g., a satellite that needs to provide communications for the European continent, can have the same antenna design as the design used for CONUS 402, simply by changing the relative phases used in the horn reflect array of the present invention.

Partially-fixed Reflective Surface Horn Reflect Array

Figure 5:
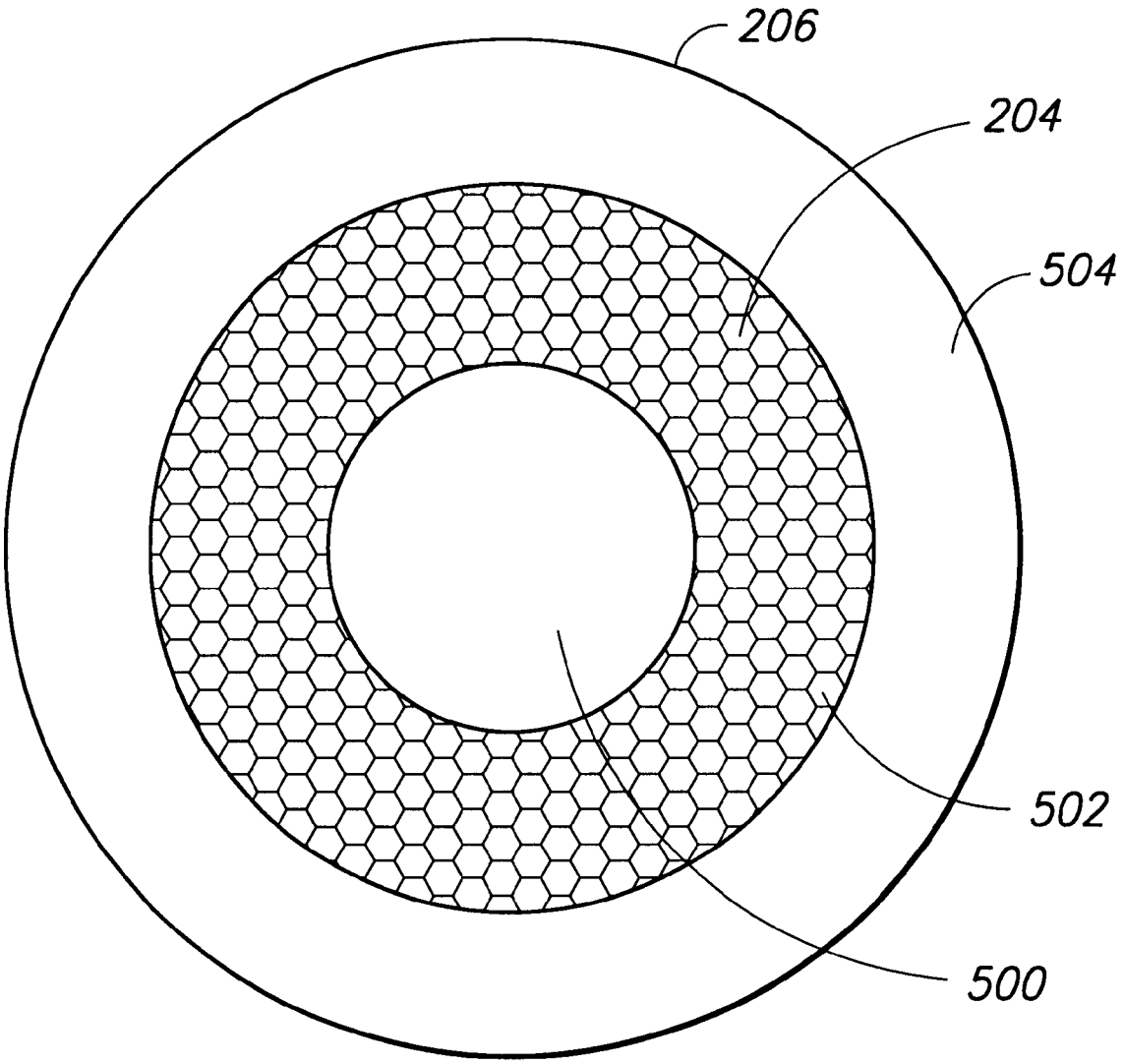
FIG. 5 illustrates a partially fixed reflective surface horn reflect array of the present invention.

FIG. 5 illustrates a partially fixed reflective surface horn reflect array of the present invention.

Reflector 206 now comprises several sections, namely center section 500, horn reflect array section 502, and outer section 504. Reflector 206 can comprise a larger or smaller number of sections without departing from the scope of the present invention.

The phase of the signal reflected by the center section 500 does not vary a large amount regardless of the shape of the beam pattern to be generated by reflector 206. Similarly, the phase of the signal reflected by outer section 504 will not change significantly regardless of the shape of the beam pattern to be generated by reflector 206. As such, horn reflect array section 502 can be reduced from the full area of reflector 206 to a subset of such area, namely horn reflect array section 502. Horn reflect array section 502 can extend through to encompass part or all of the center section 500, or extend outward to encompass part or all of outer section 504, depending on the desires of the designer and the amount of adjustment desired for the reflected beam generated by reflector 206. However, by reducing the number of horn elements 204 in reflector 206, the complexity of the horn reflect array of the present invention is reduced, while still providing reconfigurability on-station.

Process Chart

Figure 6:
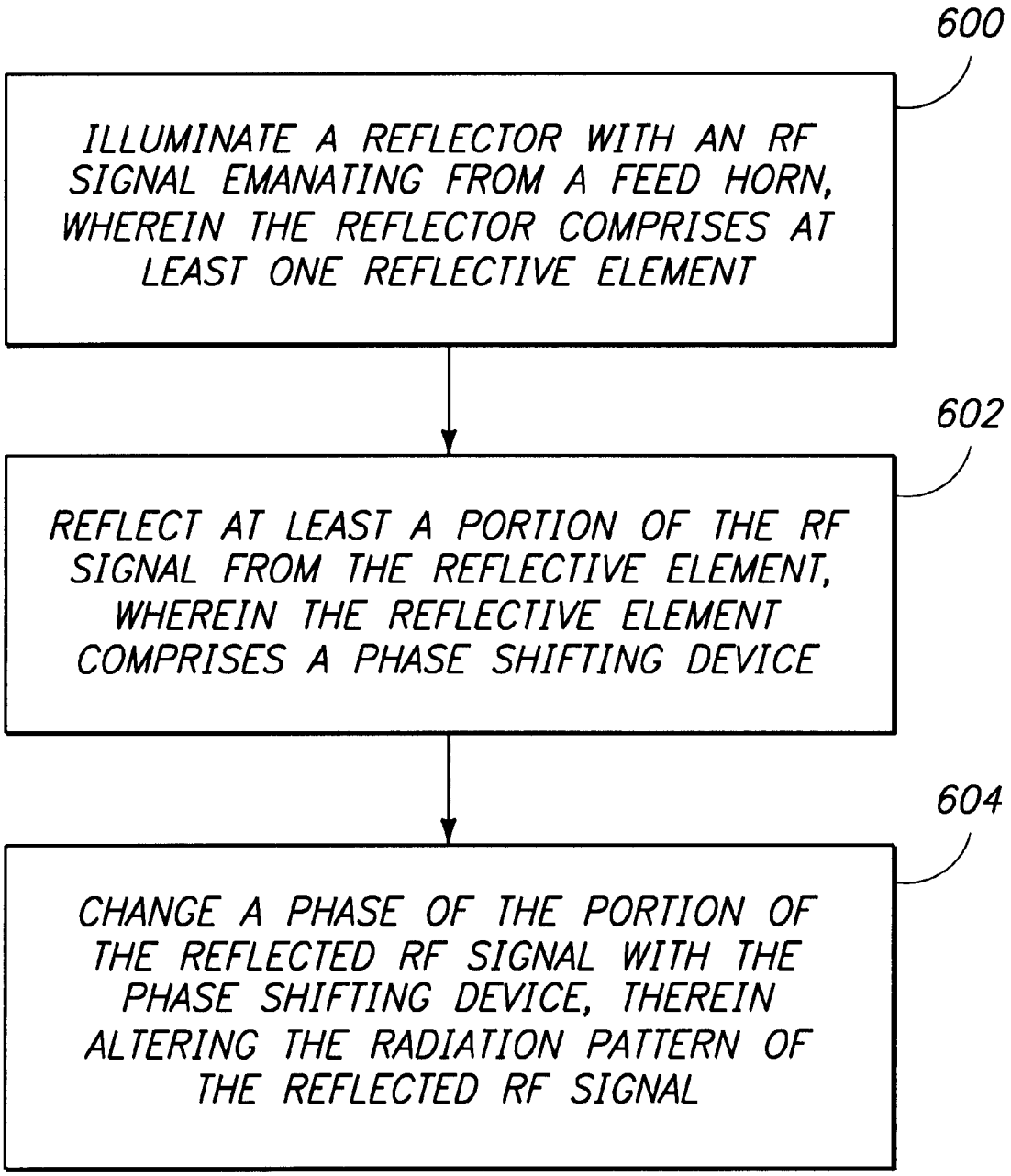
FIG. 6 is a flow chart illustrating the steps used to practice the present invention.

FIG. 6 is a flow chart illustrating the steps used to practice the present invention.

Block 600 illustrates performing the step of illuminating a reflector with an RF signal emanating from a feed horn, wherein the reflector comprises at least one reflective element.

Block 602 illustrates performing the step of reflecting at least a portion of the RF signal from the reflective element, wherein the reflective element comprises aphase shifting device; and Block 604 illustrates performing the step of changing a phase of the portion of the reflected RF signal with the phase shifting device, therein altering the radiation pattern of the reflected RF signal.

Conclusion

Some of the advantages of the invention with reference to a conventional reflector are that the present invention provides on-orbit reconfigurability of beam patterns using variable phase shifters or movable shorts. Further, since the beam patterns or profiles can be reconfigured on-station in orbit, the mechanical geometry of the antenna system can be fixed with respect to the spacecraft bus for many different mission scenarios, eliminating the performance testing and packaging redesign portions of the spacecraft construction using conventional shaped reflectors. Such a generic approach using the present invention results in cost reductions and faster construction times without sacrificing quality of the spacecraft.

In summary, the present invention discloses a horn reflect array antenna system and a method for producing a signal using a horn reflect array antenna. The system comprises at least one reflective element illuminated by an incident RF signal from a feed horn, the reflective element reflecting a portion of the incident RF signal as a portion of a reflected RF signal, and at least one phase shifting device, each phase shifting device coupled to a corresponding reflective element, wherein a beam pattern of the reflected RF signal is altered when the phase shifting element changes the phase of the portion of the reflected RF signal.

A method in accordance with the present invention comprises illuminating a reflector with an RF signal emanating from a feed horn, wherein the reflector comprises at least one reflective element, reflecting at least a portion of the RF signal from the reflective element, wherein the reflective element comprises a phase shifting device, and changing a phase of the portion of the reflected RF signal with the phase shifting device, therein altering the radiation pattern of the reflected RF signal.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A reflector array antenna, comprising:

at least one reflective element illuminated by an incident radio frequency (RF) signal from a feed horn, the reflective element reflecting at least a portion of the incident RF signal to produce a portion of a reflected RF signal;

at least one movable short, each movable short coupled to a corresponding reflective element, wherein a beam pattern of the reflected RF signal is altered when the movable short changes the phase of the portion of the reflected RF signal; and a fixed reflective area and a plurality of reflective elements, wherein a second portion of the incident RF signal is reflected from the fixed reflective area.

2. The reflect array antenna of claim 1, wherein the plurality of reflective elements are located where a large phase change for the reflected RF signal occurs, and the fixed reflective area is located where a small phase change for the reflected RF signal occurs.

3. The reflect array antenna of claim 1, wherein the plurality of reflective elements are arranged in a array, a shape of the array selected from a group comprising planar, parabolic, elliptical, spherical, hexagonal, and hyperbolic.

4. A method for generating a desired radiation pattern, comprising:

illuminating a reflector with a radio frequency (RF) signal emanating from a feed horn, wherein the reflector comprises a plurality of reflective elements;

reflecting at least a portion of the RF signal from at least one of the reflective elements, wherein the reflective element comprises a movable short;

reflecting a second portion of the incident RF signal from a fixed reflective area; and changing a phase of the portion of the reflected RF signal with the movable short, to alter a radiation pattern of the reflected RF signal to generate the desired radiation pattern.

5. The method of claim 6, wherein the plurality of reflective elements are located where a large phase change for the reflected RF signal occurs, and the fixed reflective area is located where a small phase change for the reflected RF signal occurs.

6. The method of claim 4, wherein the plurality of reflective elements are arranged in a array, a shape of the array selected from a group comprising planar, parabolic, elliptical, spherical, hexagonal, and hyperbolic.

7. A reflect array antenna, comprising:

a plurality of horn reflecting devices illuminated by an incident radio frequency (RF) signal from a feed horn, the horn reflecting device reflecting at least a portion of the incident RF signal to produce a portion of a reflected RF signal;

at least one phase shift device, each phase shifting device coupled to a corresponding horn reflecting device, wherein a beam pattern of the reflected RF signal is altered when the phase shifting element changes the phase of the portion of the reflected RF signal; and a fixed reflective area, wherein a second portion of the incident RF signal is reflected from the fixed reflective area.

8. The reflect array antenna of claim 7, wherein the phase shifting device is a moveable short.

9. The reflect array antenna of claim 7, wherein the phase shifting device is an electronic phase shifter coupled to a fixed short in the phase shifting device.

10. The reflect array antenna of claim 7, wherein the plurality of horn reflecting devices are located where a large phase change for the reflected RF signal occurs, and the fixed reflective area is located where a small phase change for the reflected RF signal occurs.

11. The reflect array antenna of claim 7, wherein the plurality of horn reflecting devices are arranged in a array, a shape of the array selected from a group comprising planar, parabolic, elliptical, spherical, hexagonal and hyperbolic.

12. A method for generating a desired radiation pattern, comprising:

illuminating a reflector with a radio frequency (RF) signal emanating from a feed horn, wherein the reflector comprises a plurality of horn reflecting devices;

reflecting at least a portion of the RF signal from at least one of the horn reflecting devices, wherein the horn reflecting device comprises a phase shifting device;

reflecting a second portion of the RF signal from a fixed reflective area; and changing a phase of the portion of the reflected RF signal with the phase shifting device, to alter a radiation pattern of the reflected RF signal to generate the desired radiation pattern.

13. The method of claim 12, wherein the phase shifting device is a moveable short.

14. The method of claim 12, wherein the phase shifting device is an electronic phase shifter coupled to a fixed short in the horn reflecting device.

15. The method of claim 12, wherein the plurality of horn reflecting devices are located where a large phase change for the reflected RF signal occurs, and the fixed reflective area is located where a small phase change for the reflected RF signal occurs.

16. The method of claim 12, further comprising a plurality of horn reflecting devices.

17. The method of claim 16, wherein the plurality of horn reflecting devices are arranged in a array, a shape of the array selected from a group comprising planar, parabolic, elliptical, spherical, hexagonal, and hyperbolic.

* * * * *